United States Patent [19]

Palmquist

[11] 3,991,800

[45] Nov. 16, 1976

[54] LOG DE-BARKING MACHINE

[75] Inventor: Harry Oskar Palmquist, Soderhamn, Sweden

[73] Assignee: Kochum Industri Aktiebolag, Sweden

[22] Filed: July 1, 1974

[21] Appl. No.: 484,765

[30] Foreign Application Priority Data

July 4, 1973 Sweden ..... 7309398

[52] U.S. Cl. ..... 144/208 E; 144/2 Z; 144/311

[51] Int. Cl.[2] ..... B27L 1/00

[58] Field of Search ..... 144/208 R, 208 E, 2 Z, 144/42, 43, 311

[56] References Cited

UNITED STATES PATENTS

| | | | |
|---|---|---|---|
| 1,887,908 | 11/1932 | Tidblad | 144/208 E |
| 2,903,028 | 9/1959 | Brundell et al. | 144/208 E |
| 3,119,422 | 1/1964 | Brown | 144/208 E |
| 3,409,057 | 11/1968 | Los | 144/2 Z X |

FOREIGN PATENTS OR APPLICATIONS

| | | | |
|---|---|---|---|
| 1,376,318 | 9/1964 | France | 144/208 E |
| 154,715 | 6/1956 | Sweden | 144/208 E |

*Primary Examiner*—Othell M. Simpson
*Assistant Examiner*—W. D. Bray
*Attorney, Agent, or Firm*—Hill, Gross, Simpson, Van Santen, Steadman, Chiara & Simpson

[57] ABSTRACT

A log de-barking machine comprising two hollow rotor type processing units, one having tools to cut helically through the bark, and the other one having tools to further subdivide the cut bark and to finally remove the bark from the log in the shape of comparatively small pieces, and further having means for advancing the logs axially thereof successively through the two hollow rotor type processing units.

1 Claim, 5 Drawing Figures

LOG DE-BARKING MACHINE

BACKGROUND OF THE INVENTION

1. Field of the Invention

This invention relates to a log de-barking machine of the hollow rotor type.

2. Prior Art

With prior art log de-barking machines of the hollow rotor type problems have been encountered when de-barking logs whose bark has extremely long fibres, particularly logs with which the nature of the bark varies greatly over the different drying stages thereof.

For example, in the case of Eucalyptus Globulus, the bark of a relatively newly felled tree adheres so loosely to the core of the tree that any de-barking tools and/or cutting knives are unable to climb the bark to cut it up into smaller pieces. Instead, the tools push the bark in front of them, so that the bark leaves the log in the form of long hoses which soon block the rotor and bark outlet.

In the case of dry logs, on the other hand, the bark is so hard that it is difficult to cut through the same. At certain drying stages, the bark adheres so firmly to the wood that it is practically integral therewith.

SUMMARY OF THE INVENTION

The log de-barking machine comprises in combination a first hollow rotor type processing unit having tools adapted to cut through the bark of a log in at least one helical cut, while permitting the bark to remain adhering to the log, tools adapted to further subdivide the cut bark, and a second hollow-rotor-type of processing unit having tools to finally remove the cut bark from the log as the log is passed through said second processing unit, and means for advancing logs longitudinally thereof successively through said first and second processing units.

The rotors of the two units may be rotated in the same direction or in mutually opposed directions. They may also be rotated at different speeds or at the same speed.

ON THE DRAWINGS

AS SHOWN ON THE DRAWINGS

Figure 1:
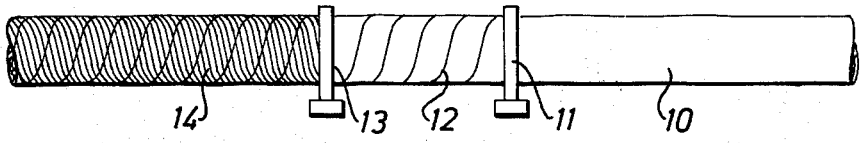
FIG. 1 shows diagrammatically the de-barking of a fresh log from a newly felled tree.

To illustrate the principles of operation of the log de-barking machine according to the present invention FIG. 1 shows diagrammatically the de-barking of a fresh log from a newly felled tree. The log 10 is moved in a direction from the right to the left of FIG. 1 through a schematically shown processing unit 11 which makes a helical cut 12 through the bark. The cut 12 is made in such a manner that the bark remains adhering to the log 10.

Subsequent to making one or more such cuts 12 through the bark on the log 10, said log 10 is moved through a second processing unit 13, similarly shown only schematically in the drawing, in which second processing unit 13 the bark is processed by means of a plurality of revolving tools to further subdivide and to finally loosen the bark from the surface of the log and, more specifically, with the bark broken up into small pieces.

It should be noted that the cutting lines 14 shown in the left hand portion of FIG. 1 do not necessarily illustrate actual cuts but only indicate the paths along which respective tools move as the log passes through the processing unit 13.

Figure 2:
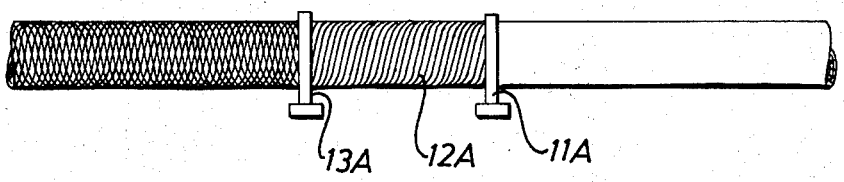
FIG. 2 shows diagrammatically the de-barking of a comparatively dry log.

Referring now to FIG. 2 which schematically illustrates the de-barking of a comparatively dry log, the bark processing operation of the two units 11*a* and 13*a*, respectively, is effected in much the same manner as by means of the units 11, 13 of FIG. 1, one difference being, however, that the unit 11*a* makes a much larger number of helical cuts 12*a* extending parallel with one another, so that the bark is cut in the de-barking unit 13*a* proper into still smaller pieces than with the de-barking method as shown in FIG. 1, viz. in pieces of rhombic configuration.

It should be mentioned that the rotors in the two units 11, 13 and 11*a*, 13*a*, respectively, may be rotated in the same direction or in mutually opposed directions. They may also be rotated at mutually different speeds of rotation or at the same speeds. It will readily be perceived that, in practice, the rotors will be provided with that number of tools, such as cutting knives and/or de-barking tools, which is best suited for the nature of the bark to be removed.

Figure 3:
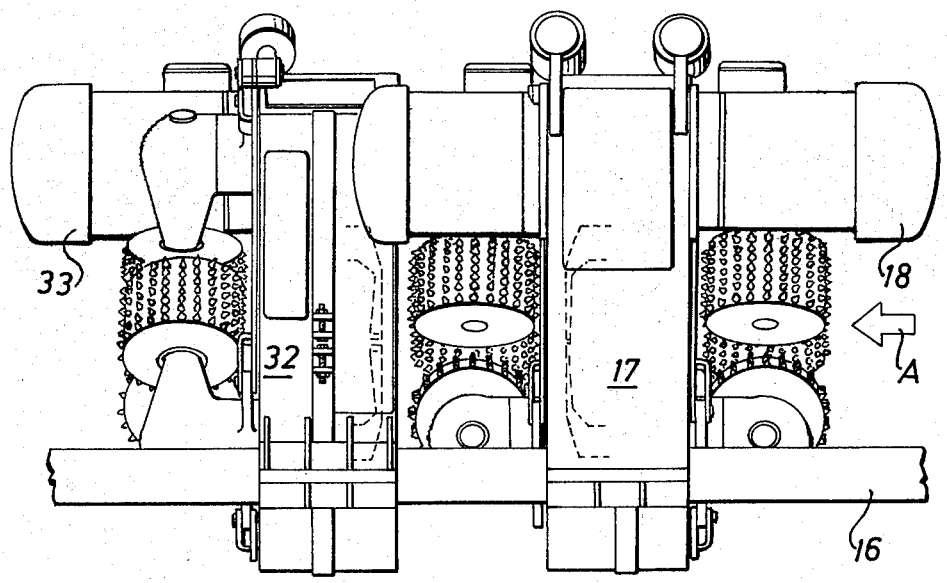
FIG. 3 is a side view of a de-barking machine according to the invention.
Figure 4:
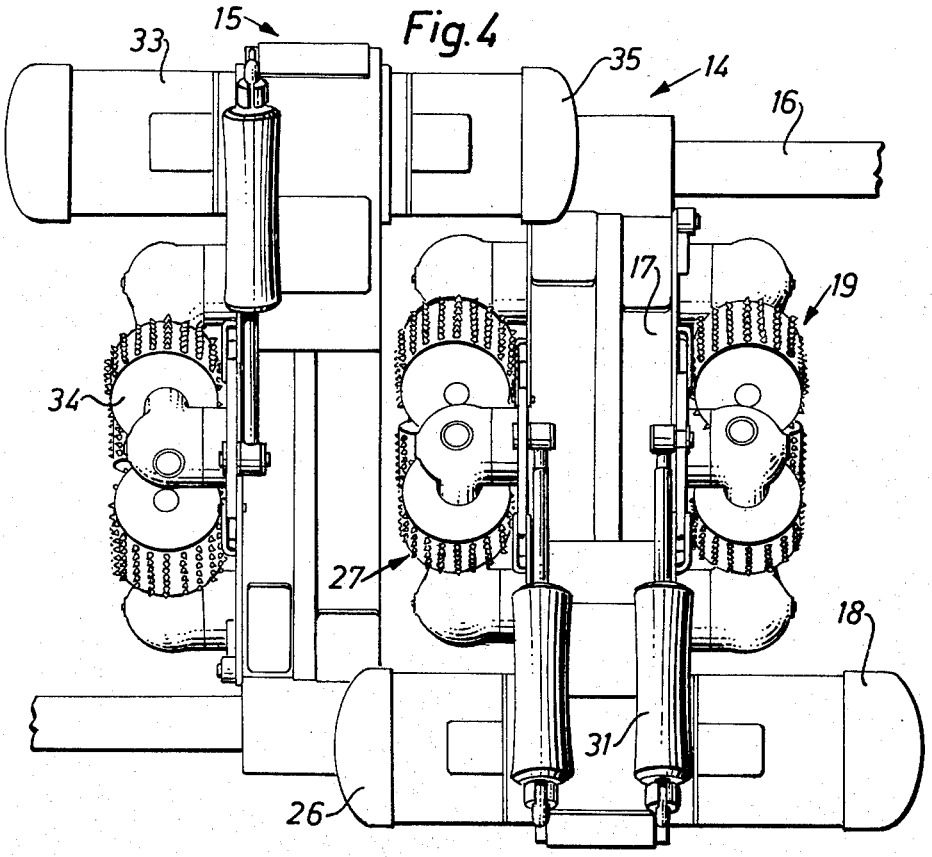
FIG. 4 is a plan view of the machine shown in FIG. 3.
Figure 5:
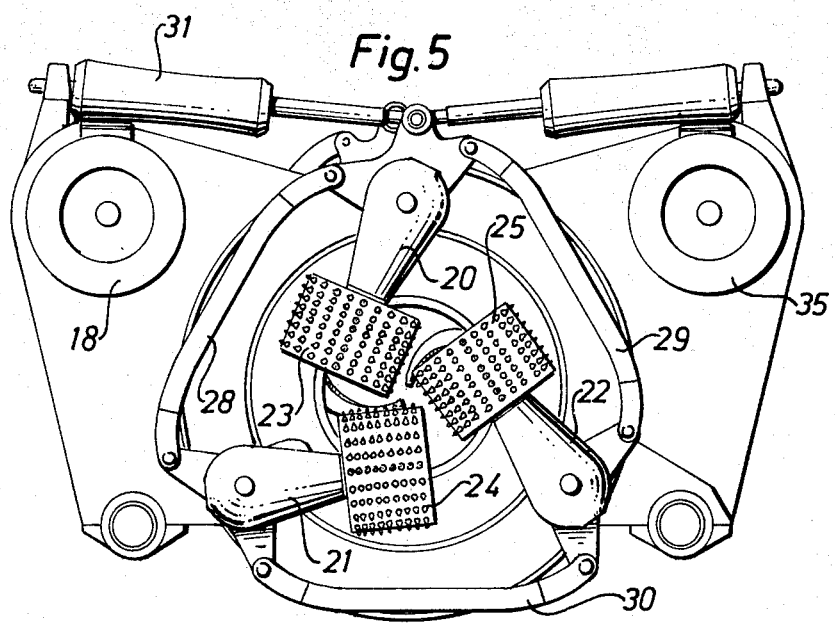
FIG. 5 is an end view of the machine shown in FIGS. 3 and 4 from the right hand end in FIG. 3.

In FIGS. 3–5 there is shown one embodiment of a de-barking machine according to the invention which machine comprises, in principle, two mutually opposed processing units, generally designated 14 and 15, respectively, through which the logs are sequentially fed in their longitudinal direction from the right to the left of FIGS. 3 and 4, as indicated by the arrow A.

In the embodiment shown, the two units 14 and 15 are assembled on a frame structure 16. The unit 14 comprises a hollow rotor type de-barking machine of known design, having a hollow rotor (not shown in detail) which is mounted for rotation in a generally ring-shaped housing 17, and which is provided with debarking tools and/or cutting knives, said rotor being driven by an electric motor 18 through a transmission not shown in the drawing. At the infeed end of the unit, the machine is provided with a conventional so-called triangular feed unit, generally shown at 19 and referred to herein as a first feed unit. The triangular feed unit comprises three spiked rollers 23, 24, 25 which are driven by means of a motor 26 arranged on the outlet side of the unit, each of said rollers being mounted for rotation on respective pivot arms 20, 21, 22. The motor 26 simultaneously drives a second triangular feed unit, generally shown at 27, on the discharge side of the unit 14. The arms 20, 21, 22 are connected together by means of arms 28, 29, 30, FIG. 5, so as to by swung synchronously with one another, and are biased in a direction towards each other by means of a combined spring and damper device 31, FIG. 5.

The second processing unit, generally shown at 15, is in principle similar to the unit 14 as described rotor is but differs therefrom in that the second triangular feed unit 27 acts as an infeed unit for the processing unit 15. In this way, less space is required for the machine in its entirety and, at the same time, an advantage is afforded in that the risk of blockages caused by bark is reduced. Thus, the unit 15 in question comprises a hollow debarking rotor (not shown) which is mounted for rotation in a generally ring-shaped housing 32 and which is provided with de-barking tools and/or cutting knives. The rotoris driven by an electric motor 33 in a manner not shown. The unit 15 has on the outlet side thereof a third triangular feed unit 34 similar in general construction to the triangular feed unit 19, said feed unit 34 being driven by an electric motor 35 in a manner not shown.

In operation of the machine the logs are advanced on to the machine by means of a suitable conveyor device from the right of FIG. 3, in the direction shown by the arrow A, and are then fed in by means of the first triangular feed unit 19. In the unit 14, one or more helical cuts are made through the bark of the logs, according to the type of logs being de-barked and the extent of dryness thereof, after which the logs are acted upon by the second triangular feed unit 27, the logs then passing to the processing unit 15, where the de-barking of the logs is completed.

Although various minor modifications might be made or suggested by those versed in the art, it should be understood that I wish to embody within the scope of the patent warranted hereon, all such embodiments as reasonably and properly come within the scope of my contribution to the art.

I claim:

1. A log debarking machine, comprising in combination:

a. a frame;

b. a first feed unit supported on said frame for infeeding a log;

c. a first hollow-rotor-type processing unit on said frame and having tools adapted to cut through the bark of a log in at least one helical cut around the log in a manner permitting the bark to adhere to the log;

d. a second feed unit on said frame operative on the portion of the log having the helical cut;

e. a second hollow-rotor-type processing unit on said frame having tools adapted to remove the helically cut bark from the log as it is received from said second feed unit; and f. a third feed unit on said frame operative on the debarked portion of the log.

* * * * *